US007134660B2

(12) United States Patent
Ethier

(10) Patent No.: US 7,134,660 B2
(45) Date of Patent: Nov. 14, 2006

(54) NO-CRAP CRAPS: CRAPLESS CRAPS DONE RIGHT

(76) Inventor: Stewart N. Ethier, 3151 Deer Haven, Wanship, UT (US) 84017

( * ) Notice: Subject to any disclaimer, the term of this patent is extended or adjusted under 35 U.S.C. 154(b) by 162 days.

(21) Appl. No.: 10/929,327

(22) Filed: Aug. 30, 2004

(65) Prior Publication Data

US 2006/0043671 A1 Mar. 2, 2006

(51) Int. Cl.
*A63F 9/04* (2006.01)

(52) U.S. Cl. ..... 273/146; 273/274

(58) Field of Classification Search ..... 273/146
See application file for complete search history.

(56) References Cited

U.S. PATENT DOCUMENTS 5,732,948 A * 3/1998 Yoseloff ..... 273/274
5,791,651 A * 8/1998 Bryant ..... 273/274
5,997,000 A * 12/1999 Nakano et al. ..... 273/274
2004/0104531 A1* 6/2004 Dreaper et al. ..... 273/274
2006/0043678 A1* 3/2006 Golden ..... 273/274

OTHER PUBLICATIONS

Scarne's Encyclopedia of Games, John Scarne, Harper & Row-1973- pp. 455-467.*

* cited by examiner

*Primary Examiner*—Eugene Kim
*Assistant Examiner*—Dolores R. Collins

(57) ABSTRACT

Crapless Craps, a game that has existed for more than 20 years, is a modification of standard craps designed to eliminate the possibility of the pass line bettor losing on the come-out roll. However, it has several serious drawbacks that have prevented it from achieving significant popularity with the gambling public. No-Crap Craps is a modification of Crapless Craps created to overcome these shortcomings. This aim is achieved by regarding every number except 7 as a point number, but with numbers 2 and 3 grouped together as 2-or-3, and numbers 11 and 12 grouped together as 11-or-12. When betting against the shooter, a seven-out after point 11-or-12 pays half. The result is that the house advantages of the pass line bet and the don't pass bet are exactly those of standard craps.

2 Claims, 2 Drawing Sheets

**Don't Pass and Don't Come: Seven-out after point 11-or-12 pays half.*

NO-CRAP CRAPS: CRAPLESS CRAPS DONE RIGHT

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates to the field of games, specifically to games played with dice, and more specifically to the casino game of craps.

2. Prior Art

Craps is a casino game played by rolling a pair of dice repeatedly. The principal bet in craps, known as the pass line bet, works as follows. On the first roll, called the "come-out" roll, there are three possibilities. If 7 or 11 is rolled (a "natural"), the pass line bet is won. If 2, 3, or 12 is rolled (a "craps number"), the pass line bet is lost. If any other number is rolled, namely 4, 5, 6, 8, 9, or 10, that number becomes the shooter's "point." If the point is repeated before 7 is rolled, the bet is won. If 7 is rolled before the point is repeated, the bet is lost. The pass line bet pays even money.

The pass line bet can be lost in either of two ways: Either the shooter rolls a craps number (2, 3, or 12) on the come-out roll, or he establishes a point and subsequently "sevens-out." In the former case, the same shooter continues to roll the dice. In the latter case, a new shooter takes control of the dice. Since most players at the craps table bet with the shooter, the shooter is motivated to win as many and lose as few pass line bets as possible before the inevitable seven-out. Rolling a craps number on a come-out roll is therefore something almost every shooter wants to avoid.

With this in mind, the casino game of Crapless Craps™ was first offered in 1981 at Bob Stupak's Vegas World. The game is not patented (its first usage was prior to 1981 in illegal private games), but its name is a registered trademark, owned by Bob Stupak (reg. no. 1610171, Aug. 14, 1990). The same game is also offered in several Mississippi casinos under the name Never Ever Craps™, a registered trademark of Grand Casinos Inc. (reg. no. 2590230, Jul. 9, 2002). The idea behind Crapless Craps is that, if, by a minor change in the rules, the possibility of losing a pass line bet on the come-out roll could be eliminated, the game would be considerably more enjoyable.

In Crapless Craps, therefore, the craps numbers 2, 3, and 12 are no longer automatic losers for the pass line bettor, but becomes points, just like 4, 5, 6, 8, 9, and 10. Similarly, 11 is no longer an automatic winner for the pass line bettor, but becomes a point. Consequently, the rules for the pass line bet are as follows. On the come-out roll, there are two possibilities. If 7 is rolled, the pass line bet is won. If any other number is rolled, namely 2, 3, 4, 5, 6, 8, 9, 10, 11, or 12, that number becomes the shooter's point. If the point is repeated before 7 is rolled, the bet is won. If 7 is rolled before the point is repeated, the bet is lost. The pass line bet pays even money.

The beauty of Crapless Craps is that it retains the basic structure of standard craps, while eliminating the the possibility of losing the pass line bet on the come-out roll.

Unfortunately, there are three serious drawbacks to Crapless Craps, which have relegated the game to an insignificant role in the world of casino gambling. (For example, it is currently offered at only one Las Vegas casino.) The three drawbacks are the following.

(a) In standard craps, one can bet with the shooter or against him. To bet against the shooter, one makes a don't pass bet, which is the reverse of the pass line bet (i.e., the criteria for winning and losing are reversed, and the bet pays even money), with one exception: If 12 is rolled on the come-out roll, the don't pass bet is tied rather than won. In Crapless Craps, there is no don't pass bet, so one is obliged to bet with the shooter. Although only a small percentage of crapshooters bet the don't pass consistently, many like to have it available when the table is "cold." Also, having the ability to bet on either side of a proposition helps to provide some assurance that the game is honest.

(b) In standard craps, even after a point has been established, the player still has at least a 1 in 3 chance of winning his pass line bet, regardless of the point. In Crapless Craps, if the point 2 or the point 12 is established, the shooter has only a 1 in 7 chance of winning his pass line bet. This is only marginally better than losing with certainty on the come-out roll.

(c) In standard craps, the house advantage for the pass line bet is 1.414 percent. In Crapless Craps, the house advantage for the pass line bet is 5.382 percent. In a fast-paced game such as craps, this distinction is huge and is largely responsible for the game's lack of success in the casino marketplace. In short, the game is widely regarded as a sucker game.

Objects and Advantages

The invention that is the subject of this patent application is an improved version of Crapless Craps, one that I call No-Crap Craps™ (trademark pending). No-Crap Craps preserves the desirable features of Crapless Craps and completely avoids the three serious drawbacks just mentioned. More precisely, No-Crap Craps has the following objects and advantages:

(a) The game retains the basic structure of standard craps.

(b) There is no possibility of losing a pass line bet on the come-out roll.

(c) The player who wants to bet against the shooter can make a don't pass bet.

(d) Even after a point has been established, the player still has at least a 1 in 3 chance of winning his pass line bet, regardless of the point.

(e) The house advantage for the pass line bet is 1.414 percent, just as it is in standard craps. The house advantage for the don't pass bet is 1.364 percent, just as it is in standard craps.

(f) No-Crap Craps, unlike other proprietary games, will have a very short learning curve. In fact, a glance at the layout should make the game almost self-explanatory to those already familiar with standard craps.

SUMMARY

Here is the main feature that distinguishes No-Crap Craps from both Crapless Craps and standard craps: Every number except 7 is a point number, but numbers 2 and 3 are grouped together as 2-or-3, and numbers 11 and 12 are grouped together as 11-or-12. Thus, there are eight, not ten, point numbers: 2-or-3, 4, 5, 6, 8, 9, 10, 11-or-12.

The rules for the pass line bet are the usual ones: On the come-out roll, there are two possibilities. If 7 is rolled, the pass line bet is won. If any other number is rolled, that number becomes the shooter's point. If the point is repeated before 7 is rolled, the bet is won. If 7 is rolled before the point is repeated, the bet is lost. The pass line bet pays even money. The house advantage for the pass line bet is 1.414 percent, exactly as it is in standard craps.

The rules for the don't pass bet are as follows. The don't pass bet is the reverse of pass line bet (i.e., the criteria for winning and losing are reversed, and the bet pays even money), with one exception: If the don't pass bet is won because the shooter sevens-out after establishing point 11-or-12, he is paid 1 to 2 instead of the usual 1 to 1. In other words, the "Bar 12" provision in standard craps becomes "Seven-out after point 11-or-12 pays half." The house advantage for the don't pass bet is 1.364 percent, exactly as it is in standard craps.

DRAWINGS: FIGURES

DETAILED DESCRIPTION OF THE INVENTION

Figure 1:
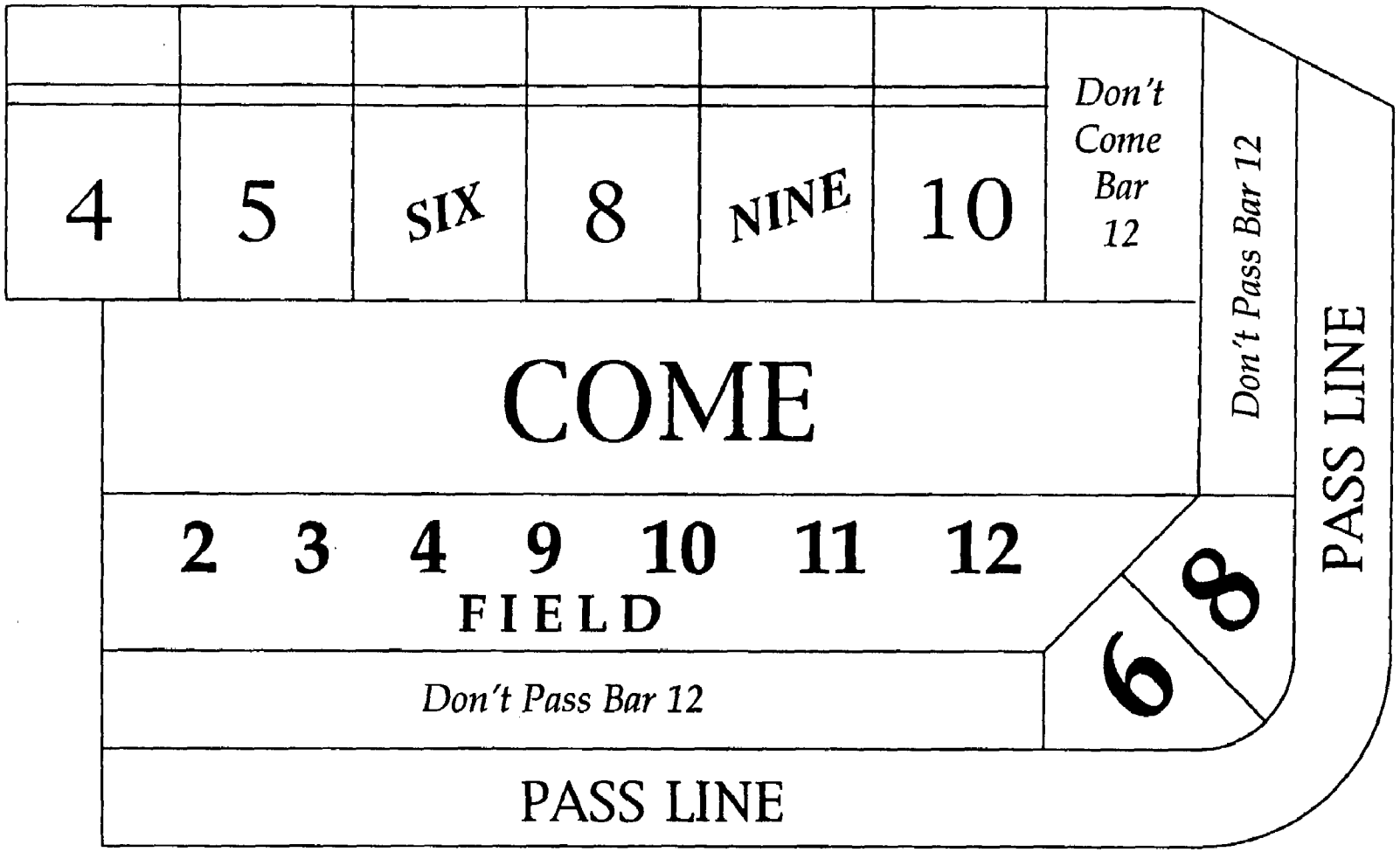
FIG. 1 is prior art. It shows the right side of the betting layout in standard craps.

No-Crap Craps is an improved version of Crapless Craps, a game that has existed for more than 20 years but has never achieved significant popularity with the gambling public because of three serious drawbacks. Notice that the term "No-Crap Craps" has a double meaning, with the adjective no-crap referring both to the crapless aspect of the game and to the fact that the game is no longer a sucker game.

Here is the main feature that distinguishes No-Crap Craps from both Crapless Craps and standard craps: Every number except 7 is a point number, but numbers 2 and 3 are grouped together as 2-or-3, and numbers 11 and 12 are grouped together as 11-or-12. Thus, there are eight, not ten, point numbers: 2-or-3, 4, 5, 6, 8, 9, 10, 11-or-12.

The rules for the pass line bet in No-Crap Craps are the usual ones: On the come-out roll, there are two possibilities. If 7 is rolled, the bet is won. If any other number is rolled, that number becomes the shooter's point. If the point is repeated before 7 is rolled, the bet is won. If 7 is rolled before the point is repeated, the bet is lost. The pass line bet pays even money.

For example, if 12 is rolled on the come-out roll, the shooter's point is 11-or-12. The pass line bet will be won if 11 or 12 is rolled before the next 7. The chances are 1 in 3. Similarly, if 11 is rolled on the come-out roll, the shooter's point is 11-or-12. Again, the pass line bet will be won if 11 or 12 is rolled before the next 7.

The house advantage for the pass line bet in No-Crap Craps is 1.414 percent, exactly as it is in standard craps. This is easy to see. The only differences between the pass line bet in No-Crap Craps and the pass line bet in standard craps occur when 2, 3, 11, or 12 is rolled on the come-out roll. These numbers contribute $(-1)(4/36)+(1)(2/36)=-2/36$ to the pass line bettor's expectation in standard craps. In No-Crap Craps these numbers contribute $2(3/36)((1)(3/(3+6))+(-1)(6/(3+6)))=-2/36$, which is identica The rules for the don't pass bet in No-Crap Craps are as follows. The don't pass bet is the reverse of pass line bet (i.e., the criteria for winning and losing are reversed, and the bet pays even money), with one exception: If the don't pass bet is won because the shooter sevens-out after establishing point 11-or-12, he is paid 1 to 2 instead of the usual 1 to 1. In other words, the "Bar 12" provision in standard craps (in which 12 on the come-out roll results in a tie for the don't pass bettor instead of a win) becomes "Seven-out after point 11-or-12 pays half." Of course, the role of 11-or-12 can be played by 2-or-3 with no probabilistic effect, just as "Bar 12" can be, and often is, replaced by "Bar 2."

The house advantage for the don't pass bet in No-Crap Craps is 1.364 percent, exactly as it is in standard craps. (Often the house advantage for the don't pass bet in standard craps is quoted as 1.403 percent. This assumes that a tie does not resolve the bet but merely delays its resolution until a win or a loss occurs. If a tie is considered as a legitimate resolution of the bet, then 1.364 percent is the correct figure.) To see this, one proceeds as in the case of the pass line bet. The numbers 2, 3, 11, and 12 contribute $(1)(3/36)+(0)(1/36)+(-1)(2/36)=1/36$ to the don't pass bettor's expectation in standard craps. The corresponding contribution for No-Crap Craps is $(3/36)((-1)(3/(3+6))+(1)(6/(3+6)))+(3/36)((-1)(3/(3+6))+(1/2)(6/(3+6)))=1/36$,which is identical.

Come bets are defined exactly as are pass line bets, except that they are initiated after the shooter has established a point. Similarly, don't come bets are defined exactly as are don't pass bets, except that they are initiated after the shooter has established a point.

Odds bets in No-Crap Craps can be made after a point is established, regardless of whether the original bet was a pass line bet, a don't pass bet, a come bet, or a don't come bet. This is exactly as in standard craps. The odds multiplier m, which specifies the maximum size of the odds bet relative to the base bet, is chosen by the casino. The only new feature in No-Crap Craps is the two new point numbers 2-or-3 and 11-or-12. In both cases the odds bet pays 2 to 1 if the original bet is a pass line or come bet, 1 to 2 if it is a don't pass or don't come bet. In other words, these two new point members are treated just like number 4 (or number 10).

In No-Crap Craps there are two new place bets, two new buy bets, and two new lay bets, due to the two new point numbers 2-or-3 and 11-or-12. These are all treated exactly as place bets, buy bets, and lay bets on 4 (or on 10) are treated.

All other bets in standard craps not yet mentioned remain in effect in No-Crap Craps. The No-Crap Craps betting layout has two small but important changes from the standard one. There are two extra boxes for the two new point numbers 2-or-3 and 11-or-12. Thus, eight point boxes must take the place of the six point boxes and the don't come box in standard craps. This can be done by extending them a bit further into the center section of the layout, just as is done in Crapless Craps with its ten point boxes and no don't come box. The don't come box in No-Crap Craps can borrow some of the space used by the come box. Compare FIGS. 1 and 2. The only other change has already been mentioned: The "Bar 12" provision in the don't pass and don't come boxes in standard craps becomes "Seven-out after point 11-or-12 pays half." Because this phrase requires more space, the simplest solution is to put an asterisk on the words don't pass and don't come in the three places they occur (on each side of the layout), with the phrase "Seven-out after point 11-or-12 pays half" appearing only once (on each side of the layout) just above the point boxes. See FIG. 2.

CONCLUSIONS, RAMIFICATIONS, AND SCOPE OF THE INVENTION

As should now be clear, No-Crap Craps successfully addresses several serious drawbacks of Crapless Craps without introducing any new ones. Its advantages can be summarized as follows.

(a) The game retains the basic structure of standard craps. Specifically, there is a come-out roll on which 7 results in a win for the pass line bettor and any other number establishes a point. In the latter case, the pass line bet is won if the point is repeated before 7 is rolled, and is otherwise lost.

(b) There is no possibility of losing a pass line bet on the come-out roll. Just as in Crapless Craps, there are only two possibilities on the come-out roll: Either the pass line bet is immediately won or a point is established.

(c) The player who wants to bet against the shooter can make a don't pass bet. Also available are don't come bets, odds bets associated with don't pass bets and don't come bets, and lay bets.

(d) Even after a point has been established, the player still has at least a 1 in 3 chance of winning his pass line bet, regardless of the point. The corresponding figure for Crapless Craps is 1 in 7.

(e) The house advantage for the pass line bet is 1.414 percent, just as it is in standard craps. The house advantage for the don't pass bet is 1.364 percent, just as it is in standard craps. This is important, in order for the game to be regarded by the gambling public as a viable alternative to standard craps. Combined with advantage (b), it may well be regarded not just as a viable alternative, but as a preferable alternative.

(f) No-Crap Craps, unlike other proprietary games, will have a very short learning curve. In fact, a glance at the layout should make the game almost self-explanatory to those already familiar with standard craps. Indeed, the eight point numbers appear explicitly on the layout. This explains the pass line and come bets. The "Seven-out after point 11-or-12 pays half" provision appears explicitly on the layout and explains the don't pass and don't come bets. The only other new bets, the two new odds bets and the two new place, buy, and lay bets can be easily explained by saying that they are just like the corresponding bets on 4 (or on 10).

A few ramifications of the rules of No-Crap Craps, which may not be obvious to the reader, include the following.

How do the odds bets affect the house advantage? Consider first the case of m-times odds associated with a pass line bet or a come bet. The house advantage of 1.414 percent (or 28/1980 or 7/495) must be divided by the expected amount bet, assuming a one-unit base bet. In standard craps, this is 1+(2/3)m, because a point is established 2/3 of the time. In No-Crap Craps, it is 1+(5/6)m, because a point is established 5/6 of the time. For single, double, and triple odds, the figures for No-Crap Craps (with those for standard craps in parentheses) are 0.771 (0.848), 0.530 (0.606), and 0.404 (0.471) percent. In particular, No-Crap Craps has a smaller house advantage when the odds factor is the same. For this reason it is recommended that casinos use the same odds factor at No-Crap Craps as they do at standard craps. It will soon become common knowledge that No-Crap Craps gives the player a slightly better deal, although it will not actually cost the casino anything.

In the case of m-times odds associated with a don't pass bet or a don't come bet, it is not the amount bet but rather the amount of the potential win that is limited to m times the amount of the base bet. The house advantage of 1.364 percent (or 27/1980 or 3/220) must be divided by the expected amount bet, assuming a one-unit base bet. In standard craps, this is 1+m. In No-Crap Craps, it is 1+(4/3) m. For single, double, and triple odds, the figures for No-Crap Craps (with those for standard craps in parentheses) are 0.584 (0.682), 0.372 (0.455), and 0.273 (0.341) percent.

The expected number of rolls per pass line decision in No-Crap Craps exceeds that in standard craps by ½. It is well known that in standard craps the expected number of rolls per pass line decision is $^{557}/_{165}$, or about 3.376. In No-Crap Craps, the figure is therefore $^{667}/_{165}$, or about 4,042. From some players (e.g., those who bet only on the pass line), this will mean slightly less revenue, while from others it will mean slightly more because of the two additional (high percentage) place bets, buy bets, and lay bets. For example, "32-across-the-board," in which a bettor covers all six point numbers in standard craps with bets of sizes 5, 5, 6, 6, 5, 5, will become "42-across-the-board."

Each time a shooter sevens out, a new shooter takes control of the dice. It is well known that in standard craps, the expected number of rolls per shooter, or the expected length of the shooter's hand, is $^{1671}/_{196}$, or about 8.526 rolls. In No-Crap Craps the figure is $(^{667}/_{165})(^{495}/_{251})=7.972$. Thus, the shooter's hand is slightly shorter on average, although, by way of compensation, there are no losing pass line decisions prior to the seven-out.

Figure 2:
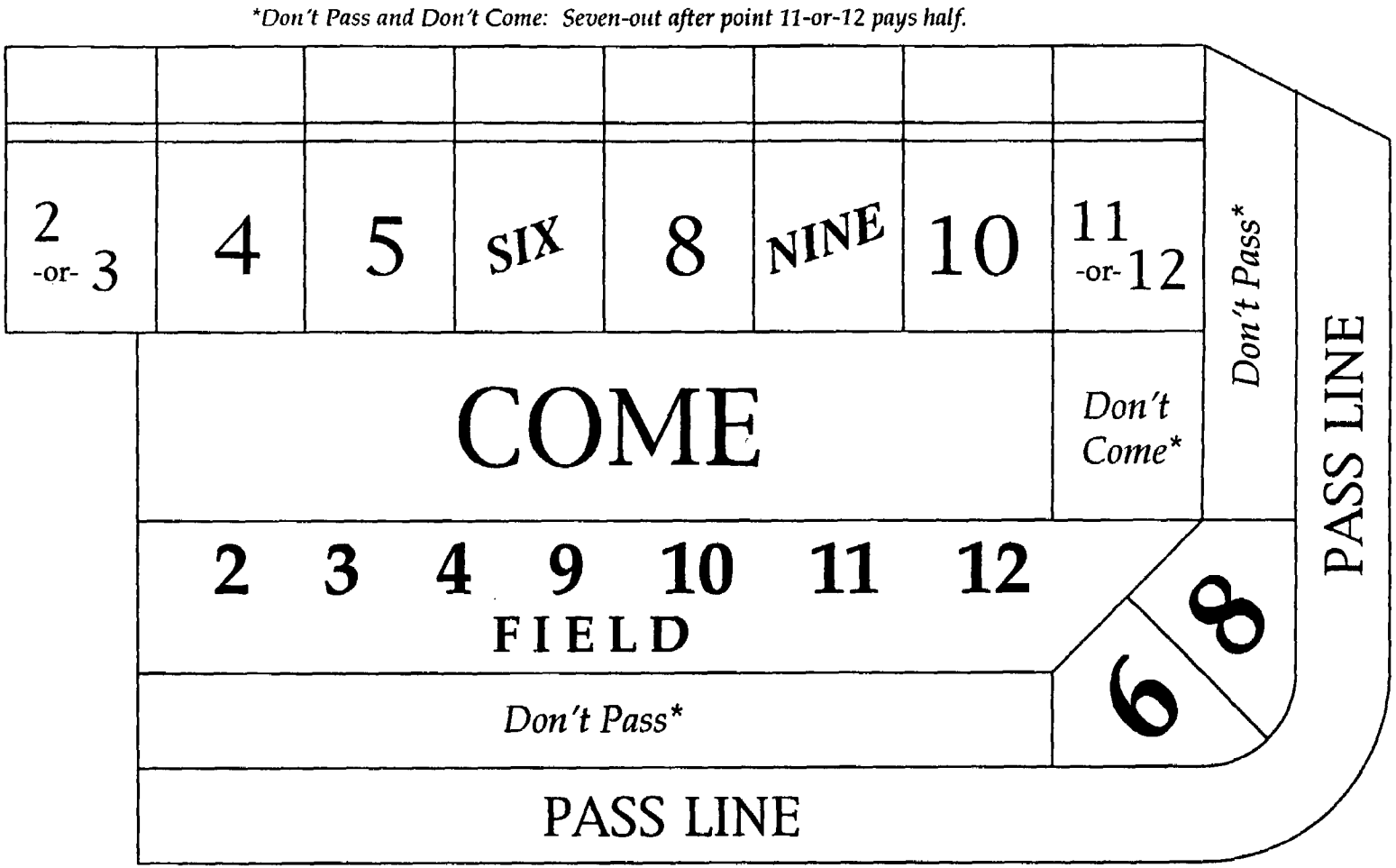
FIG. 2 shows the right side of the betting layout in No-Crap Craps. This is of course only the preferred embodiment of the new layout.

The betting layout proposed in FIG. 2 is included solely to indicate the ease with which the standard layout (FIG. 1) can be modified to accommodate No-Crap Craps. Clearly, there are a number of other ways of accomplishing the same thing. FIG. 2 is the preferred embodiment only and should not be interpreted as limiting the scope of the invention. The scope is determined solely by the appended claims.

I claim:

1. A method of playing a craps-like dice game comprising:

(a) a bettor making a pass line bet;

(b) a shooter rolling a pair of dice repeatedly;

(c) declaring that 7 on the initial, or come-out, roll results in a win for said bettor;

(d) declaring that any other number on said come-out roll establishes a point of said shooter, with the provision that numbers 2 and 3 are grouped together as 2-or-3, and numbers 11 and 12 are grouped together as 11-or-12;

(e) declaring that, following the establishment of said point, repeating said point before 7 is rolled results in a win for said bettor, whereas rolling 7 before said point is repeated results in a loss for said bettor;

(f) declaring that said pass line bet pays even money;

whereby said pass line bet cannot be lost on said come-out roll and offers the same advantage to the house as does the pass line bet in standard craps.

2. A method of playing a craps-like dice game comprising:

(a) a bettor making a don't pass bet;

(b) a shooter rolling a pair of dice repeatedly;

(c) declaring that 7 on the initial, or come-out, roll results in a loss for said bettor;

(d) declaring that any other number on said come-out roll establishes a point of said shooter, with the provision that numbers 2 and 3 are grouped together as 2-or-3, and numbers 11 and 12 are grouped together as 11-or-12;

(e) declaring that, following the establishment of said point, rolling 7 before said point is repeated results in a win for said bettor, whereas repeating said point before 7 is roiled results in a loss for said bettor;

(f) declaring tat said don't pass bet pays even money, with one exception, namely, if said don't pass bet is won following the establishment of point 11-or-12, it pays 1 to 2;

whereby said don't pass bet allows said bettor to bet against said shooter and offers the same advantage to the house as does the don't pass bet in standard craps.

* * * * *